US008141686B2

(12) United States Patent
Broyan

(10) Patent No.: US 8,141,686 B2
(45) Date of Patent: Mar. 27, 2012

(54) CORNER LIFT DEVICE

(76) Inventor: Frederick Kenneth Broyan, Berwick, PA (US)

( * ) Notice: Subject to any disclaimer, the term of this patent is extended or adjusted under 35 U.S.C. 154(b) by 0 days.

(21) Appl. No.: 12/803,572

(22) Filed: Jun. 29, 2010

(65) Prior Publication Data

US 2011/0072733 A1 Mar. 31, 2011

Related U.S. Application Data

(63) Continuation of application No. 11/375,663, filed on Mar. 13, 2006, now abandoned.

(51) Int. Cl.
*B66B 11/02* (2006.01)
*B66B 9/00* (2006.01)
*B66B 7/00* (2006.01)

(52) U.S. Cl. ..... 187/401; 187/406; 52/30

(58) Field of Classification Search ..... 187/249, 187/401, 406, 409, 408; 104/127; *B66B 7/00, B66B 17/00, 17/04, 9/00*
See application file for complete search history.

(56) References Cited

U.S. PATENT DOCUMENTS

| | | | | |
|---|---|---|---|---|
| 3,032,377 | A * | 5/1962 | Blase | 187/409 |
| 4,946,006 | A * | 8/1990 | Kume | 187/249 |
| 5,372,072 | A * | 12/1994 | Hamy | 104/93 |
| 6,098,758 | A * | 8/2000 | Gates | 187/250 |
| 6,830,133 | B2 * | 12/2004 | Sneed | 187/408 |
| 2006/0231350 | A1 * | 10/2006 | Hashiguchi | 187/401 |
| 2007/0209292 | A1 * | 9/2007 | Broyan | 52/30 |

FOREIGN PATENT DOCUMENTS

| | | | |
|---|---|---|---|
| DE | 20206290 | U1 * | 8/2002 |
| EP | 1564176 | A1 * | 8/2005 |
| FR | 2892713 | A1 * | 5/2007 |
| JP | 50124063 | A * | 10/1975 |
| JP | 04016479 | A * | 1/1992 |
| JP | 06064871 | A * | 3/1994 |
| JP | 10139327 | A * | 5/1998 |
| JP | 2003063754 | A * | 3/2003 |

* cited by examiner

*Primary Examiner* — Michael Mansen
*Assistant Examiner* — Stefan Kruer
(74) *Attorney, Agent, or Firm* — Thomas R. Shaffer

(57) ABSTRACT

A lifting device is provided in a wall corner of a room in a building at an intersection of a first wall and a second wall. The device includes a vertical guide rail mounted to the first wall right angle corner point and to a second wall right angle corner point. A corner guide rail is mounted to the wall corner. A lift container has the configuration of a right triangle with the first side wall being one leg of the triangle and the second side wall being the other leg of the triangle. A door opening is provided along the hypotenuse of the triangle. The lift container has guide members positioned on each of three corner points thereon to guide the lift container along the guide rails. A drive motor located on the top in the center of the triangular form moves the container vertically upward and downward.

10 Claims, 3 Drawing Sheets

CORNER LIFT DEVICE

This application is a continuation of U.S. patent application Ser. No. 11/375,663 filed Mar. 13, 2006 now abandoned.

BACKGROUND OF THE INVENTION

1. Field of the Invention

The present invention relates to a lifting device for transporting items of personal property between floors of a building. More specifically, it relates to a lifting device designed to be placed into any corner of a room.

2. Description of the Prior Art

Various types of elevators and lifting devices have been proposed in the past. Schreiber et al., U.S. Pat. No. 3,951,236, discloses a mountable hoist used as a non-personnel lifting device. The invention allows articles to be lifted by the hoist to any desired height including a height above the top of the hoist principal channel member. The patent teaches that a mountable hoist 9 includes a principal channel 10 and a secondary channel 12 movably mounted therein. Principal channel 10 is preferably a segmented channel member which can be increased in height to correspond to the level of the scaffold associated therewith. (Col. 2, Lines 59-64). This arrangement is best shown in FIG. 2 wherein secondary channel 12 is shown to telescope within the primary channel 10.

Seitz, U.S. Pat. No. 1,596,462, also discloses a hoist and corresponding hoist frame. The patent teaches that one of the objects of the invention is the provision of a hoist frame in the form of a tower made up of a plurality of sections, thereby permitting the height thereof to be varied according to the requirements. The patent specifically teaches that each of the standards 14 and 17 is provided at its lower end with a sleeve like extension 18, attached in any suitable manner thereto, the outer diameter of the said extension fitting closely into the respective standard to which it is attached and also into the standard below the same. In order to hold the tower sections in proper positions, the top tower 16 is provided with a plurality of hooks 19' to which are fastened to the ends of cables 19', the lower ends of the ladder being wound upon drums 20. (Page 1, lines 62-73). Thus, Seitz discloses one form of a telescopic frame as clearly shown in FIG. 5. This patent also teaches the provisions of platforms 52 which may be placed upon the sectional tower.

Druschel, U.S. Pat. No. 1,658,042, discloses a portable elevator. The frame includes splice plates 26, having a series of holes 27, rigidly secured to the flanges at the bottom end of the upper and intermediate runway channels and splice angles 28, having a series of holes 29 which are rigidly secured to the outside of the webs at the upper ends of the lower and intermediate runway channels, as plainly shown in FIGS. 3 and 4. When the upper and lower channels are aligned with their ends abutting, holes 27 will align with holes 29, and bolts may be passed through these holes to hold the runway sections in proper alignment as shown in FIG. 5. Looking at FIGS. 3 and 4, it appears that some height adjustment could be made by selecting which holes 27 align with which holes 29.

Esenmann, U.S. Pat. No. 5,131,505; Rivera, U.S. Pat. No. 5,690,190; and Olsen et al., U.S. Pat. No. 5,020,641, each teach the provision of elevator guide rails which are formed with segments which are abutted end to end.

Olsen, U.S. Pat. No. 4,664,230, and Fitzgibbon, U.S. Pat. No. 3,693,761, each disclose elevator systems which employ a top mounted motor with an associated sprocket gear and chain mechanism to provide the lifting force.

Many of the deficiencies and problems with the devices described in the above referenced patents were overcome by applicants prior invention as described in Broyan, U.S. Pat. No. 6,425,463. Applicant hereby incorporates said patent by reference thereto.

The present invention operates in a manner similar to that described in Broyan, U.S. Pat. No. 6,425,463, but has many important structural differences. A major problem with Broyan, U.S. Pat. No. 6,425,463, and with the other cited references is that such devices require a great deal of floor space in the home or building in which they are installed. Many buildings lack sufficient space for the installation of a lifting device.

There remains, therefore, a need for a lifting device which utilizes significantly less floor space and which can be provided in a building in any non-obstructive manner. The present invention solves this problem by providing a lifting device specifically designed to be placed or installed into the corner of a room or building.

SUMMARY OF THE INVENTION

In its simplest form, the present invention provides a lifting device for transporting items of personal property between one floor to another floor in a building having at least two floors, said building having a corner formed at an intersection of first wall and a second wall and also having a lowermost floor of said building being served by said lifting device and an uppermost floor of said building being served by said lifting device, comprising: a. a first guide rail mounted adjacent to said first wall at a location spaced from said corner, said first guide rail extending between the floor of the lowermost floor and the ceiling of the uppermost floor; b. a second guide rail mounted adjacent to said second wall any location spaced from said corner, said second guide rail extending between the floor of the lowermost floor and the ceiling of the uppermost floor; c. a corner guide rail mounted adjacent to said corner, said corner guide rail extending between the floor of the lowermost floor and the ceiling of the uppermost floor; d. a lift container having a top wall, a bottom wall, a first side wall and a second side wall, said lift container generally having the configuration of a right triangle with said first side wall being one leg of the triangle and said second side wall being the other leg of the triangle and having a door opening along a hypotenuse of the triangle, said lift container having guide members positioned on each of three corners thereon to guide the lift container along said guide rails and to allow the lift container to move vertically along said guide rails; and e. drive means to move the container vertically upward and vertically downward to desired locations between the lowermost floor and the uppermost floor.

Preferably, said corner guide rail is mounted at approximately 45° angles relative to said first wall and to said second wall.

Preferably, said lifting device further comprising at least one corner guide rail support block member for mounting said guide rail, said corner guide rail support being generally triangular in shape.

Preferably, said first guide rail and said second guide rail are attached to said first wall and to said second wall, respectively, at an angle of approximately 90°.

Preferably, said first guide rail and said second guide rail are attached to said first wall and to said second wall, respectively, by means of 2×4 lumber support members attached to said walls.

Preferably, said first guide rail, said second guide rail and said corner guide rail are each formed to have a cross-section generally in the shape of the letter C.

Preferably, said lift container guide members are formed of a non-metallic material.

Preferably, said top wall, bottom wall, first side wall and second side wall, said lift container are each formed of a fire resistant material.

Preferably, said lift container can be accessed from the front of the lift container through a door on a container front wall connected between said first side wall and said second side wall of said container. Preferably, said container front wall has a central portion and two end portions, each end portion being connected to said center portion at an angle of approximately 135° and said container front wall is adapted to receive cabinet facing material or other facade.

Preferably, said container further comprises a rear wall portion, said rear wall portion having opposite ends connected to said container first side wall and said second side wall at an angle of approximately 135°.

DETAILED DESCRIPTION OF THE PREFERRED EMBODIMENTS

Figure 1:
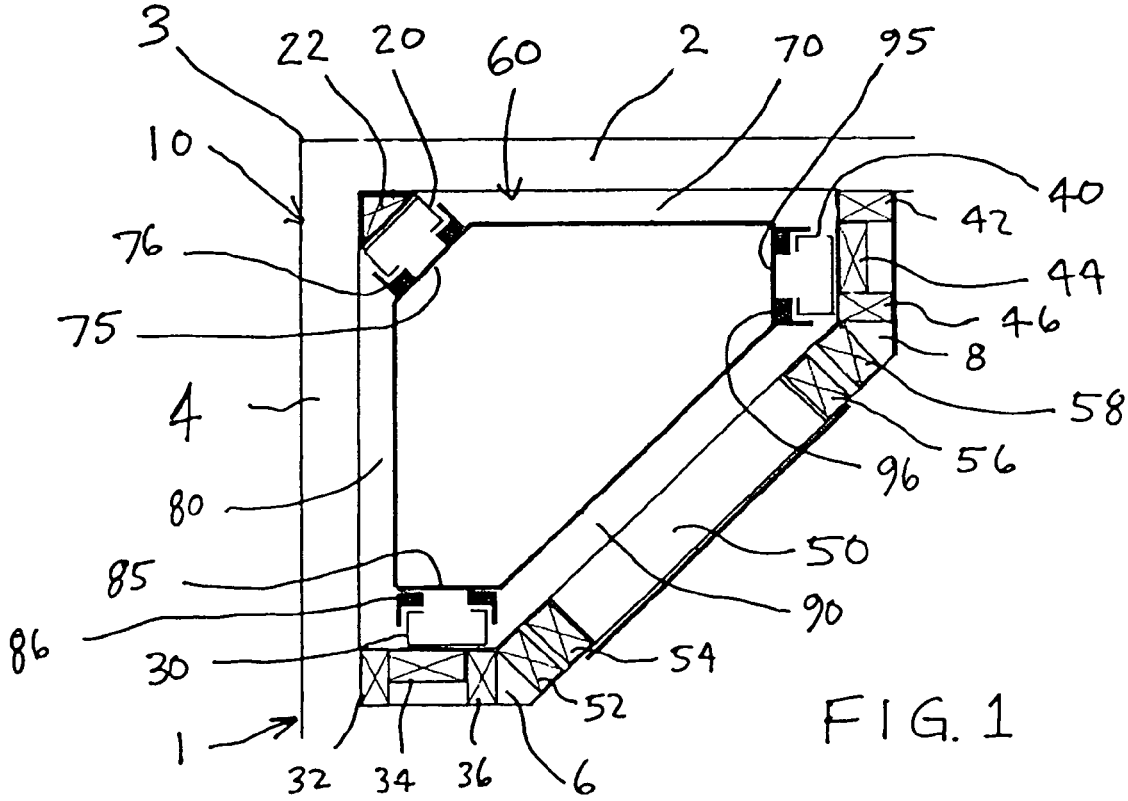
FIG. 1 is a cross sectional view showing the corner lift device of the present invention.

Referring to the figures, a lifting device 10 is provided for transporting items of personal property between one floor 100 and another floor 200 in a building having at least two floors. The building 1 has a corner 3 formed at an intersection of first wall 2 and a second wall 3 and also has a lowermost floor 100 of said building being served by said lifting device and an uppermost floor 200 of said building being served by said lifting device 10. The first wall 2 and the second wall 4 are formed of fire resistant materials.

The lifting device 10 has a first guide rail 40 mounted adjacent to said first wall 2 at a location spaced from said corner 3. First guide rail 30 extending between the floor 100 of the lowermost floor and the ceiling 300 of the uppermost floor 200. Likewise, a second guide rail 30 is mounted adjacent to said second wall 4 at a location spaced from said corner 3 and said second guide rail 30 also extends between the floor 100 of the lowermost floor and the ceiling 300 of the uppermost floor 200. The first guide rail 40 and the second guide rail 30 are attached to said first wall 2 and to said second wall 4, respectively, at an angle of approximately 90°. The first guide rail 40 is attached to said first wall 2 by means of 2×4 lumber support members 42, 44 and 46. Likewise, the second guide rail 30 is attached to said second wall 4 by means of 2×4 lumber support members 32, 34 and 36.

A third guide rail is referred to as corner guide rail 20 mounted adjacent to said corner 3. The corner guide rail 20 also extends between the floor of the lowermost floor 100 and the ceiling 300 of the uppermost floor 200. The corner guide rail 20 is mounted at approximately 45° angles relative to said first wall 2 and to said second wall 4. At least one generally triangular corner guide rail support block member 22 is provided for mounting said guide rail 20 into sad corner 3. The first guide rail 40, said second guide rail 30 and said corner guide rail 20 are each formed to have a cross-section generally in the shape of the letter C.

Figure 2:
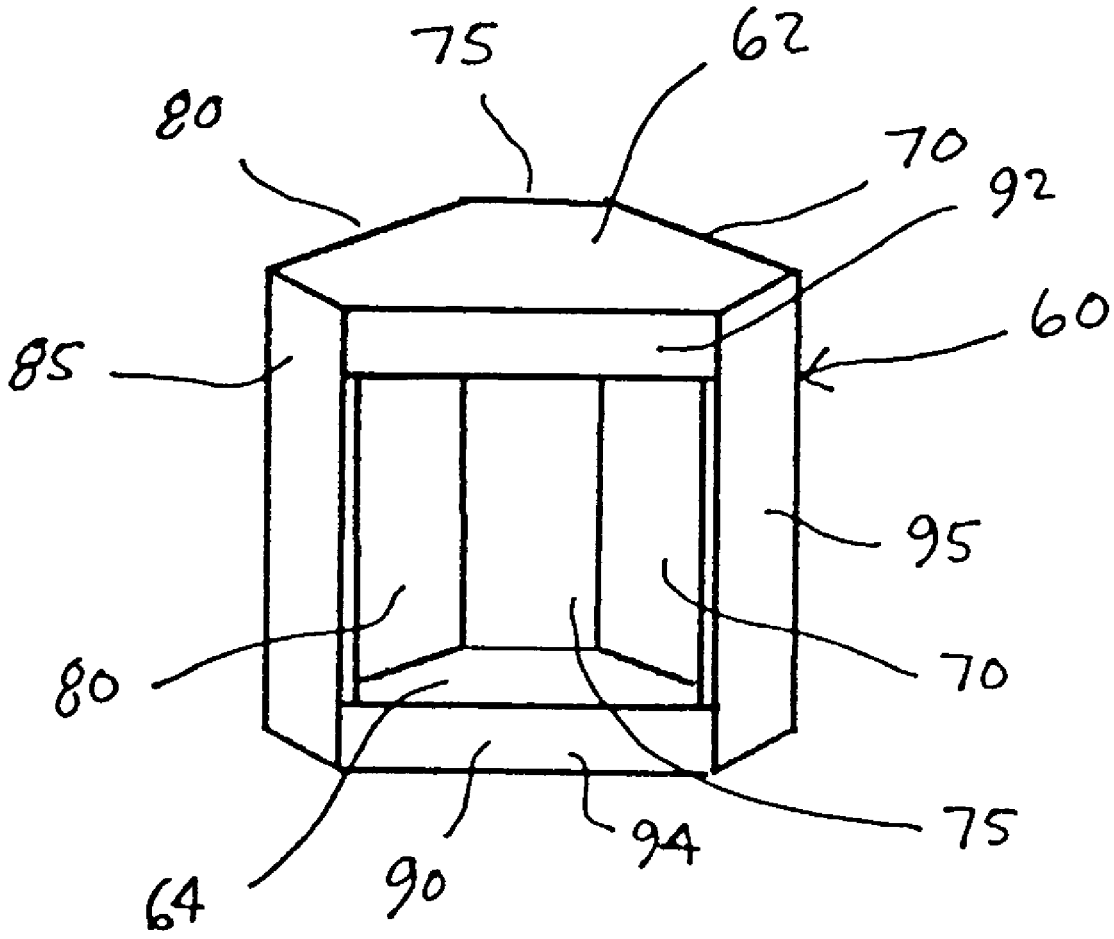
FIG. 2 is a perspective view showing the lift container of the present invention.
Figure 3:
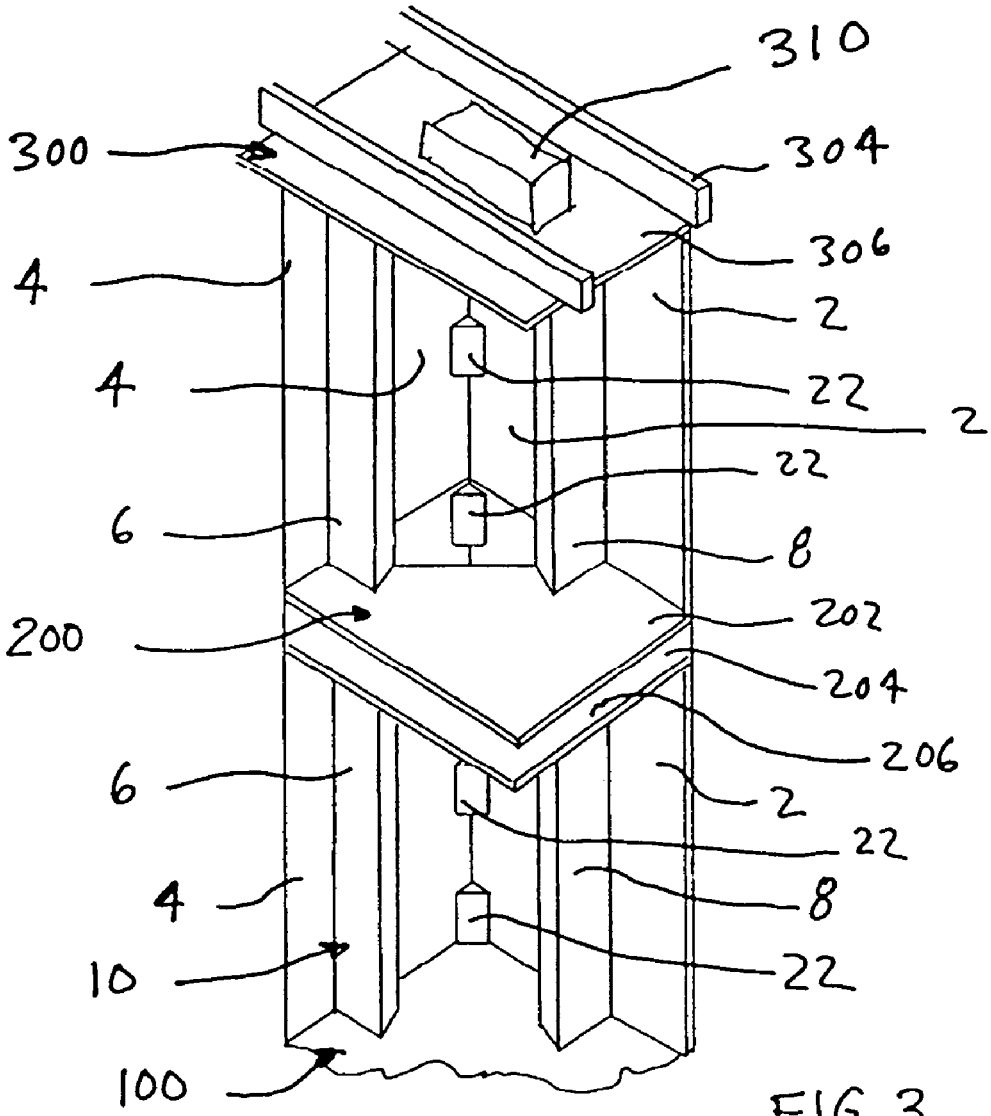
FIG. 3 is a perspective view showing two floors of a building as prepared to receive a corner lift device of the present invention.

A lift container 60 is provided (FIG. 2) which has a top wall 62, a bottom wall 64, a first side wall 70 and a second side wall 80. The lift container 60 generally has the configuration of a right triangle with said first side wall 70 being one leg of the triangle and said second side wall 80 being the other leg of the triangle and having a door 90 opening along a hypotenuse of the triangle. The lift container 60 has guide members 76, 86 and 96 positioned, respectively, on each of three corners 75, 85 and 95 thereon to guide the lift container 60 along said guide rails 20, 30 and 40 and to allow the lift container 60 to move vertically along said guide rails 20, 30 and 40. The guide members 76, 86 and 96 are formed of a non-metallic material. The top wall 62, bottom wall 64, first side wall 70 and second side wall 80 of the lift container are also formed of fire resistant materials. The lift container 60 can be accessed from the front 90 of the lift container through a door provided between front supports 92 and 94 which are connected between said first side wall 70 and said second side wall 80 of said container. Preferably, said container front wall 90 has a central portion 92, 94 and two end portions 85 and 95, each end portion being connected to said center portion 90, 92 at an angle of approximately 135°. The container front wall 90 is adapted to receive cabinet facing material or other facade. The container 60 further comprises a rear wall portion 75, said rear wall portion 75 having opposite ends connected to said container first side wall 70 and said second side wall 80 at an angle of approximately 135°.

A drive means 310 is utilized to move the container vertically upward and vertically downward to desired locations between the lowermost floor 100 and the uppermost floor 200. Further details regarding said drive means are set forth in detail in Broyan, U.S. Pat. No. 6,425,463.

While I have shown and described the presently preferred embodiment of my invention, the invention is not limited thereto and may be otherwise variously practiced within the scope of the following claims:

I claim:

1. A lifting device for transportation between one floor to another floor in a building having at least two floors, said building having a wall corner formed at an intersection of a first wall and a second wall of a room in said building and also having a lowermost floor of said building being served by said lifting device and an uppermost floor of said building being served by said lifting device, said lifting device comprising:

a. a first guide rail located at a right angle corner and mounted adjacent to said first wall at a location spaced from said corner, said first guide rail located at a right angle corner and extending between the floor of the lowermost floor and the ceiling of the uppermost floor, said first wall extending from said corner to a location further from said corner than said first guide rail;

b. a second guide rail located at a right angle corner and mounted adjacent to said second wall at a location spaced from said corner, said second guide rail located at a right angle corner and extending between the floor of the lowermost floor and the ceiling of the uppermost floor, said second wall extending from said corner to a location further from said corner than said second guide rail;

c. a corner guide rail mounted adjacent to said wall corner, said corner guide rail extending between the floor of the lowermost floor and the ceiling of the uppermost floor, wherein said first guide rail located at a right angle corner, said second guide rail located at a right angle corner and said corner guide rail are each formed to have a cross-section generally in the shape of the letter C;

d. a lift container having a top wall, a bottom wall, a first side wall and a second side wall, said lift container having the configuration of a right triangle with said first side wall being one leg of the right triangle and said second side wall being the other leg of the right triangle and having a door opening along a hypotenuse of the triangle, said lift container having guide members positioned on each of three extreme corners thereon to guide the lift container along said guide rails and to allow the lift container to move vertically along said guide rails, said guide members each being located on an extreme corner of said right triangle whereby each guide member is adjacent to two of three legs of the right triangle, said three legs being said first leg, said second leg and said hypotenuse wherein said lifting device also has a right triangular cross sectional configuration which corresponds to the configuration of said lift container; and e. drive means to move the container vertically upward and vertically downward to desired locations between the lowermost floor and the uppermost floor.

2. A lifting device according to claim 1 wherein said lift container can be accessed from the front of the lift container through a door on a container front wall connected between said first side wall and said second side wall of said container.

3. A lifting device according to claim 2 wherein said container front wall has a central portion and two end portions, each end portion being connected to said central portion at an angle of approximately 135°.

4. A lifting device according to claim 1 wherein said corner guide rail is mounted at approximately a 45° angle relative to said first wall and to said second wall.

5. A lifting device according to claim 1 further comprising at least one corner guide rail support block member for mounting said corner guide rail, said corner guide rail support block member being right triangular in shape.

6. A lifting device according to claim 1 wherein said first guide rail and said second guide rail are attached to said first wall and to said second wall, respectively, at an angle of approximately 90°.

7. A lifting device according to claim 1 wherein said first guide rail and said second guide rail are attached to said first wall and to said second wall, respectively, by means of 2×4 lumber support members attached to said walls.

8. A lifting device according to claim 1 wherein said lift container guide members are formed of a non-metallic material.

9. A lifting device according to claim 1 wherein said top wall, said bottom wall, said first side wall and second side wall of said lift container are each formed of a fire resistant material.

10. A lifting device according to claim 1 wherein said container further comprises a rear wall portion, said rear wall portion having opposite ends connected to said container first side wall and said second side wall at an angle of approximately 135°.

* * * * *